US006976853B2

(12) United States Patent
Goto

(10) Patent No.: US 6,976,853 B2
(45) Date of Patent: Dec. 20, 2005

(54) ELECTRICAL CONNECTOR WITH REGULATION MEANS

(75) Inventor: Masayuki Goto, Tokyo (JP)

(73) Assignee: Hirose Electric Co., Ltd., Tokyo (JP)

( * ) Notice: Subject to any disclaimer, the term of this patent is extended or adjusted under 35 U.S.C. 154(b) by 0 days.

(21) Appl. No.: 10/942,022

(22) Filed: Sep. 16, 2004

(65) Prior Publication Data

US 2005/0070137 A1 Mar. 31, 2005

(30) Foreign Application Priority Data

Sep. 26, 2003 (JP) ..... 2003-335837

(51) Int. Cl.[7] ..... H01R 12/00
(52) U.S. Cl. ..... 439/74; 439/660
(58) Field of Search ..... 439/74, 81, 83, 439/78, 346, 660

(56) References Cited

U.S. PATENT DOCUMENTS 5,885,092 A * 3/1999 Ito et al. ..... 439/74
5,931,689 A * 8/1999 Patel ..... 439/346
6,793,506 B1 * 9/2004 Hirata et al. ..... 439/74
2001/0014548 A1 * 8/2001 Matsukawa ..... 439/74
2001/0027036 A1 * 10/2001 Goto ..... 439/74
2004/0185690 A1 * 9/2004 Huang ..... 439/74
2005/0009383 A1 * 1/2005 Okura et al. ..... 439/74

FOREIGN PATENT DOCUMENTS

JP 2001-273949 10/2001

* cited by examiner

*Primary Examiner*—Hien Vu
(74) *Attorney, Agent, or Firm*—Takeuchi&Kubotera, LLP

(57) ABSTRACT

An electrical connector includes a first connector having first contact elements; a second connector having second contact elements brought into contact with the first contact elements when the first and second connectors are plugged to each other; an arranging section provided on the first connector so as to support the first contact elements thereon; a fitting cavity provided on the second connector so as to support the second contact elements on a wall thereof; first projections and recesses provided on the arranging section; and second projections and recesses provided on the wall of the fitting cavity so as to mesh with the first projections and recesses when the first and second connectors are plugged to each other.

6 Claims, 13 Drawing Sheets

ELECTRICAL CONNECTOR WITH REGULATION MEANS

BACKGROUND OF THE INVENTION

1. Field of the Invention

The present invention relates to electrical connectors and, particularly, to an electrical connector with a regulation means for preventing shift of a contact element.

2. Description of the Related Art

JP 2001-273949 discloses a conventional female connector of the surface mount type such as shown in FIG. 15. The female connector 1 has a pair of recesses 11 that roughly regulate the plugging position with a mating connector. However, it has no regulation means for accurately regulating the plugging position and contact positions at which the contact elements are brought into contact with each other. Consequently, a contact element 13, for example, can be shifted upon plugging by a contact element or wall of a mating connector, resulting in the poor contact between the contact elements. This becomes critical in the pitch direction that the contact elements are arranged. The smaller the width of contact elements or the intervals at which the contact elements are arranged, the more serious the problem is.

SUMMARY OF THE INVENTION

In view of the above problem, it is an object of the invention to provide an electrical connector with a regulation means for regulating accurately the plugging position and the contact position at which the contact elements are brought into contact with each other.

According to one aspect of the invention there is provided an electrical connector which includes a first connector having a plurality of first contact elements; a second connector having a plurality of second contact elements that are brought into contact with the first contact elements when the first and second connectors are plugged to each other in a plugging direction; at least one arranging section provided on the first connector and extending in both in the plugging direction and a longitudinal direction that is perpendicular to the plugging direction so as to support the first contact elements thereon; at least one fitting cavity provided on the second connector and extending backwardly in the plugging direction and in the longitudinal direction so as to support the second contact elements on a wall thereof at positions corresponding to those of the first contact elements; a plurality of first projections and recesses provided on the arranging section in the longitudinal direction; and a plurality of second projections and recesses provided on the wall of the fitting cavity so as to mesh with the first projections and recesses when the first and second connectors are plugged to each other.

According to another aspect of the invention there is provided a first connector to be plugged to a second connector in a plugging direction, which includes at least one arranging section extending in both the plugging direction and a longitudinal direction that is perpendicular to the plugging direction; a plurality of first contact elements provided on the arranging section and brought into contact with a plurality of second contact elements provided on a wall of a fitting cavity in the second connector when the first and second connectors are plugged to each other; and a plurality of first projections and recesses provided on the arranging section in the longitudinal direction to mesh with a plurality of second projections and recesses provided on the wall of the fitting cavity when the first and second connectors are plugged to each other.

According to still another aspect of the invention there is provided a second connector to be plugged to a first connector in a plugging direction, which includes at least one fitting cavity extending backwardly in the plugging direction and in a longitudinal direction perpendicular to the plugging direction; a plurality of second contact elements provided on a wall of the fitting cavity and brought into contact with a plurality of first contact elements provided on an arranging section of the first connector when the first and second connectors are plugged to each other; and a plurality of second projections and recesses provided on the wall of the fitting cavity so as to mesh with a plurality of first projections and recesses on the arranging section when the first and second connectors are plugged to each other.

The first projections may be made by both the first contact elements and the arranging section, only the first contact elements, or only the arranging section. The first contact elements may be provided adjacent to or in contact with the projections at a side thereof. The second contact elements may be provided adjacent to or in contact with the second recesses at a side thereof.

The first contact elements may be provided adjacent to or in contact with the arranging section at a side thereof and the second contact elements may be provided adjacent to or in contact with the wall of the fitting cavity at a side thereof. The first contact elements may be provided adjacent to or in contact with the arranging section on opposite sides thereof and the second contact elements are provided in the fitting cavity on opposite sides thereof. The electrical connector may further comprise at least one first slope provided on the arranging section for guiding the second connector and at least one second slope provided on a wall of the fitting cavity for guiding the first connector.

According to the invention, not only the plugging position between the connectors is regulated accurately but also the contact positions between contact elements are regulated to assure a good contact between them. Especially, it prevents a longitudinal shift of contact elements. The contact between contact elements is kept so good as to provide an electrical connector having narrower contact elements and/or smaller intervals at which contact elements are arranged.

DESCRIPTION OF THE PREFERRED EMBODIMENTS

An electrical connector consists of a male connector and a female connector. The contact elements of the male and female connectors are brought into one-to-one contact with each other electrically and physically. The male and female connectors will be described below separately. The invention will be described by example of surface mounted electrical connectors but is not limited to this type of electrical connectors.

A. First Embodiment

1. Male Connector

Figure 1:
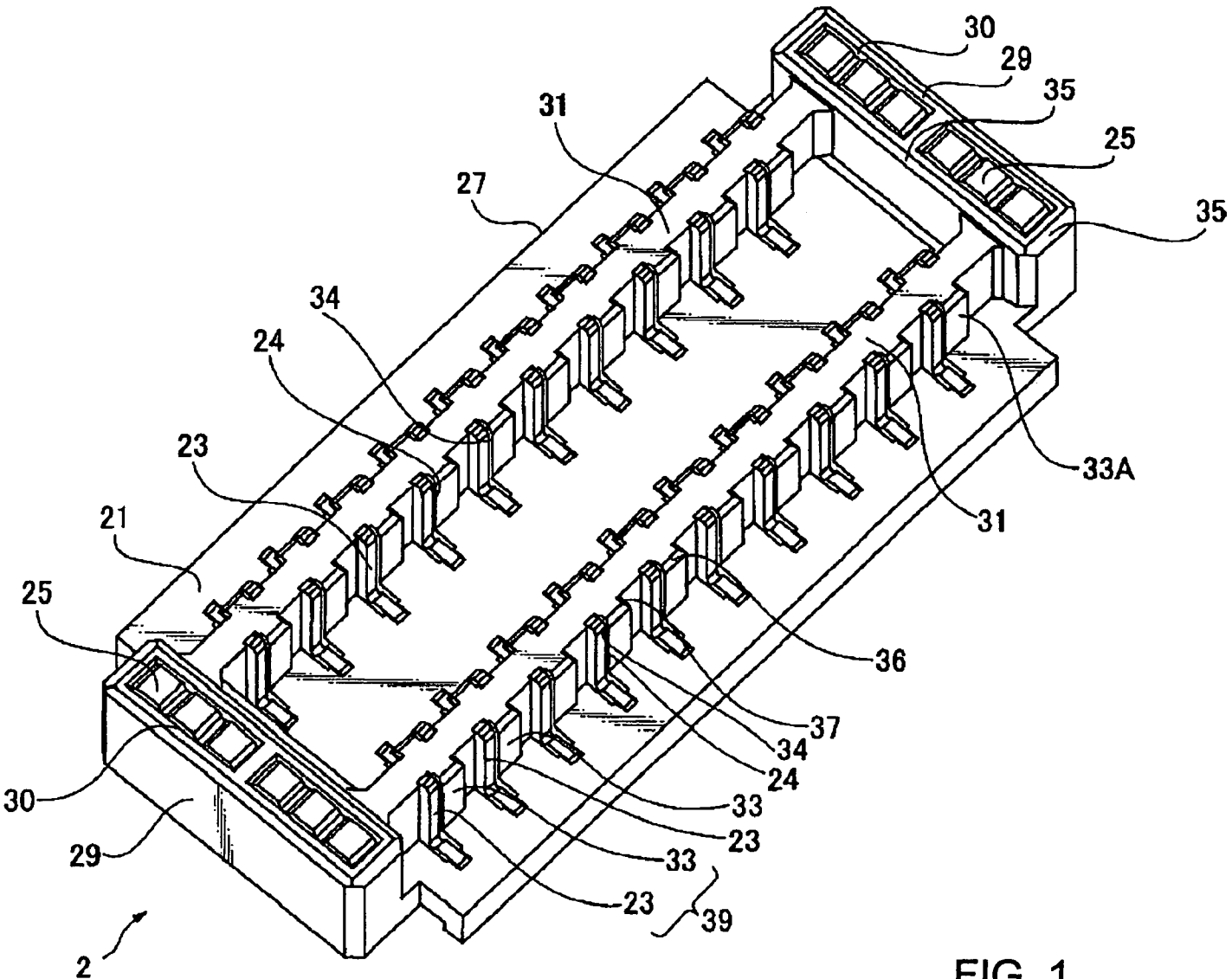
FIG. 1 is a perspective view of a male connector according to the first embodiment of the invention.
Figure 2:
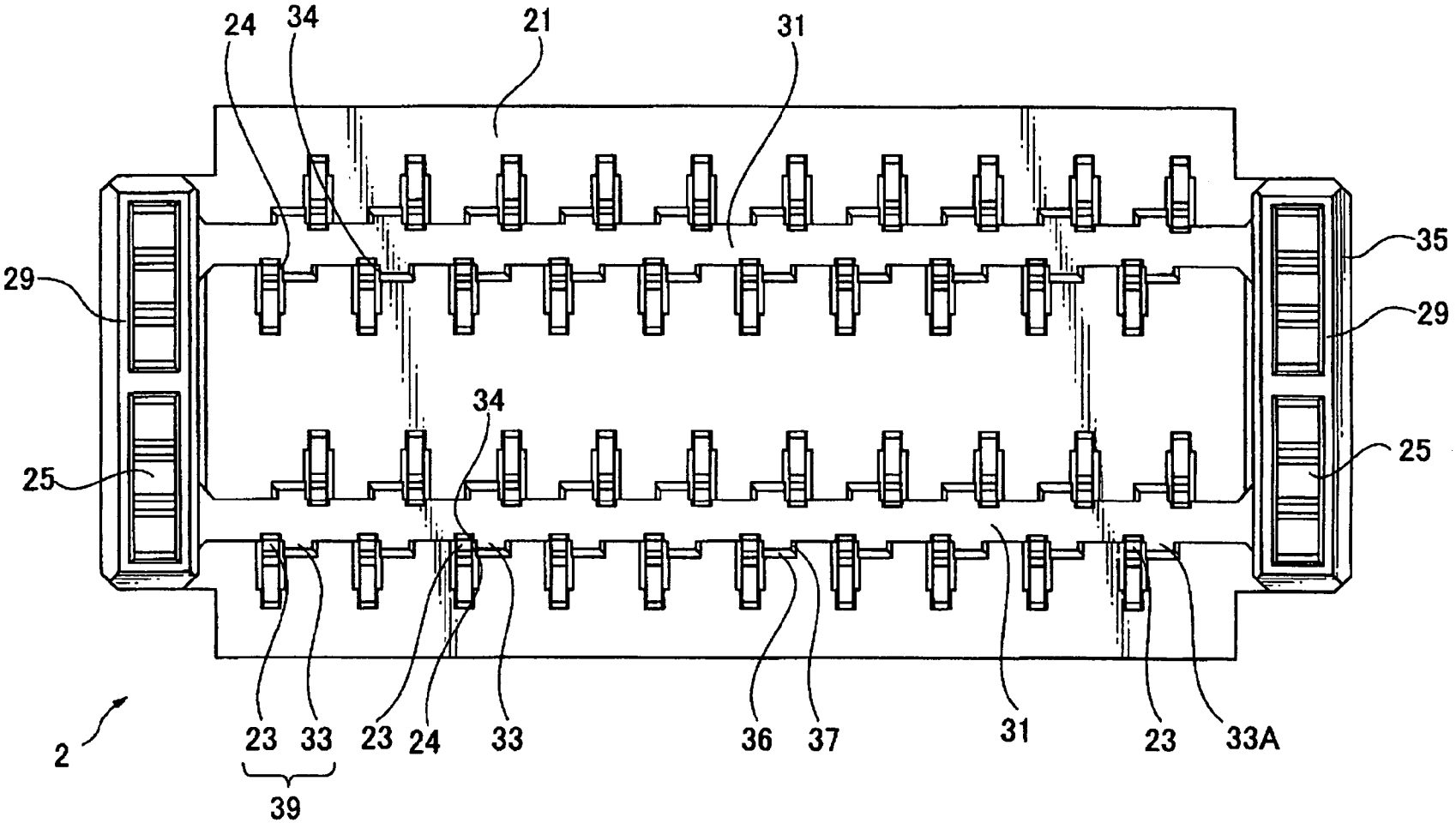
FIG. 2 is a plan view of the male connector.

In FIGS. 1 and 2, a male connector 2 includes an insulating hosing 21, a plurality of male contact elements 23 fixed to the insulating housing 21, and a pair of reinforcing members 25 attached to the insulating housing 21 for fixing the male connector 2 to a circuit board. The male connector 2 is surface mounted on the circuit board by soldering the bottom of the reinforcing members 25.

The insulating housing 21 has a base plate 27, a pair of reinforcing member holding sections 29, and a pair of contact element arranging sections 31. The holding sections 29 extend from opposite ends of the bottom plate 27 toward the mating connector 4 and have a rectangular shape. Similarly, the arranging sections 31 extend from the bottom plate 27 toward the female connector 4 and in the direction perpendicular to the plugging direction for connection with the holding sections 29. A plurality of recesses are provided in the arranging section 31 in the longitudinal direction.

The contact elements 23 are arranged in the recesses in the arranging section 31 in a zigzag fashion on opposite surfaces at regular intervals. Each male contact element 23 is disposed beside each projection 33 provided on the arranging section 31 so that a side wall of the male contact element 23 is next to or in contact with an outer wall 34 of the projection 33. Consequently, any shift of the male contact element 23 in the longitudinal direction is prevented. The male contact element 23 and the projection 33 constitute a larger projection 39, which affects engagement with the female connector 4 described later.

To facilitate plugging between the female connector 4 and the male connector 2, guiding slopes 35 and 37 are provided on the holding sections 29 and the arranging sections 31, respectively. The guiding slopes 35 and 37 also absorb an impact upon plugging between the male and female connectors 2 and 4. Especially, the projection 33 has a guiding slope 36 extending in the longitudinal direction and a guiding slope 37 extending in the direction perpendicular to the longitudinal and plugging directions.

2. Female Connector

Figure 3:
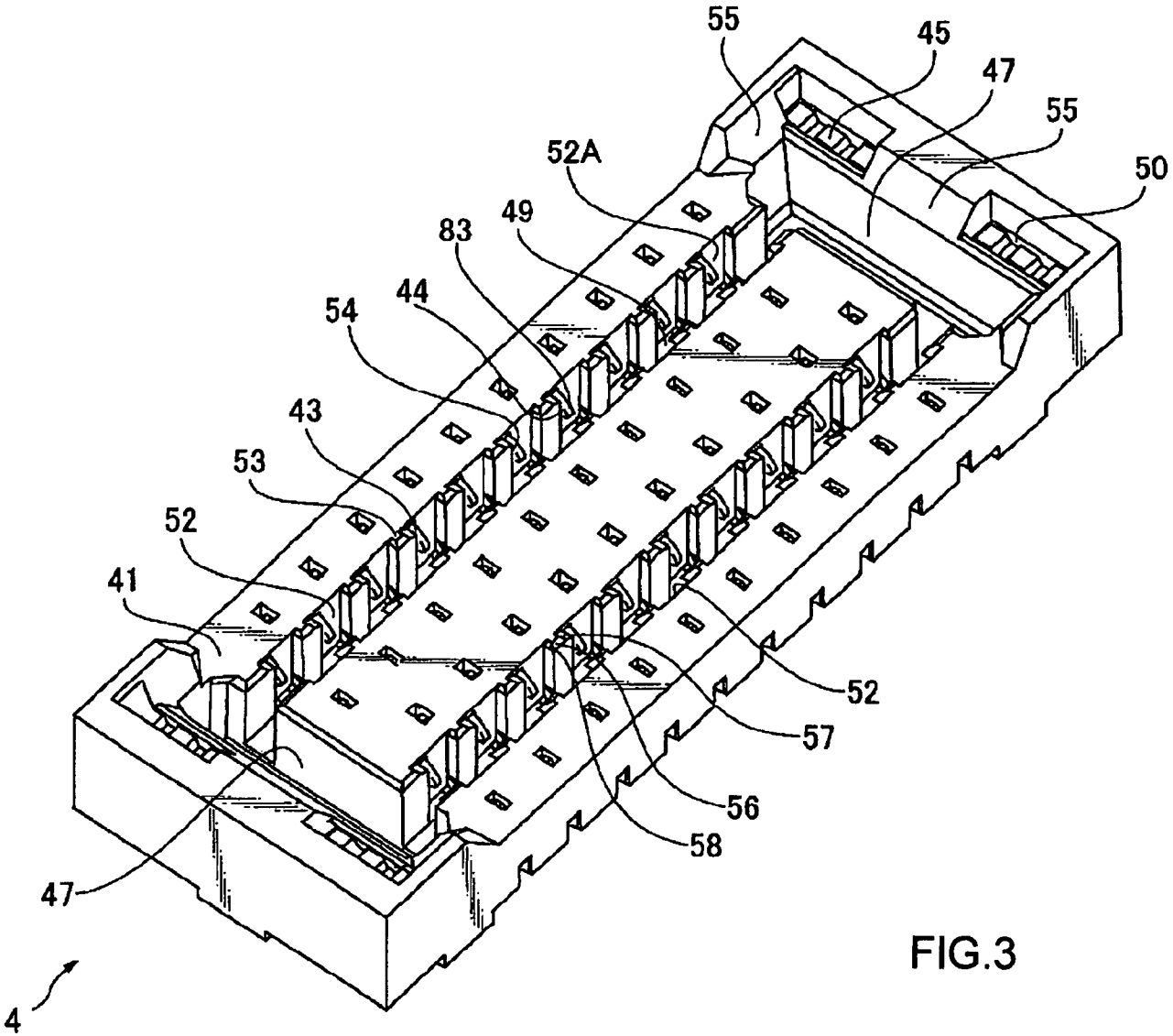
FIG. 3 is a perspective view of a female connector according to the first embodiment of the invention.
Figure 4:
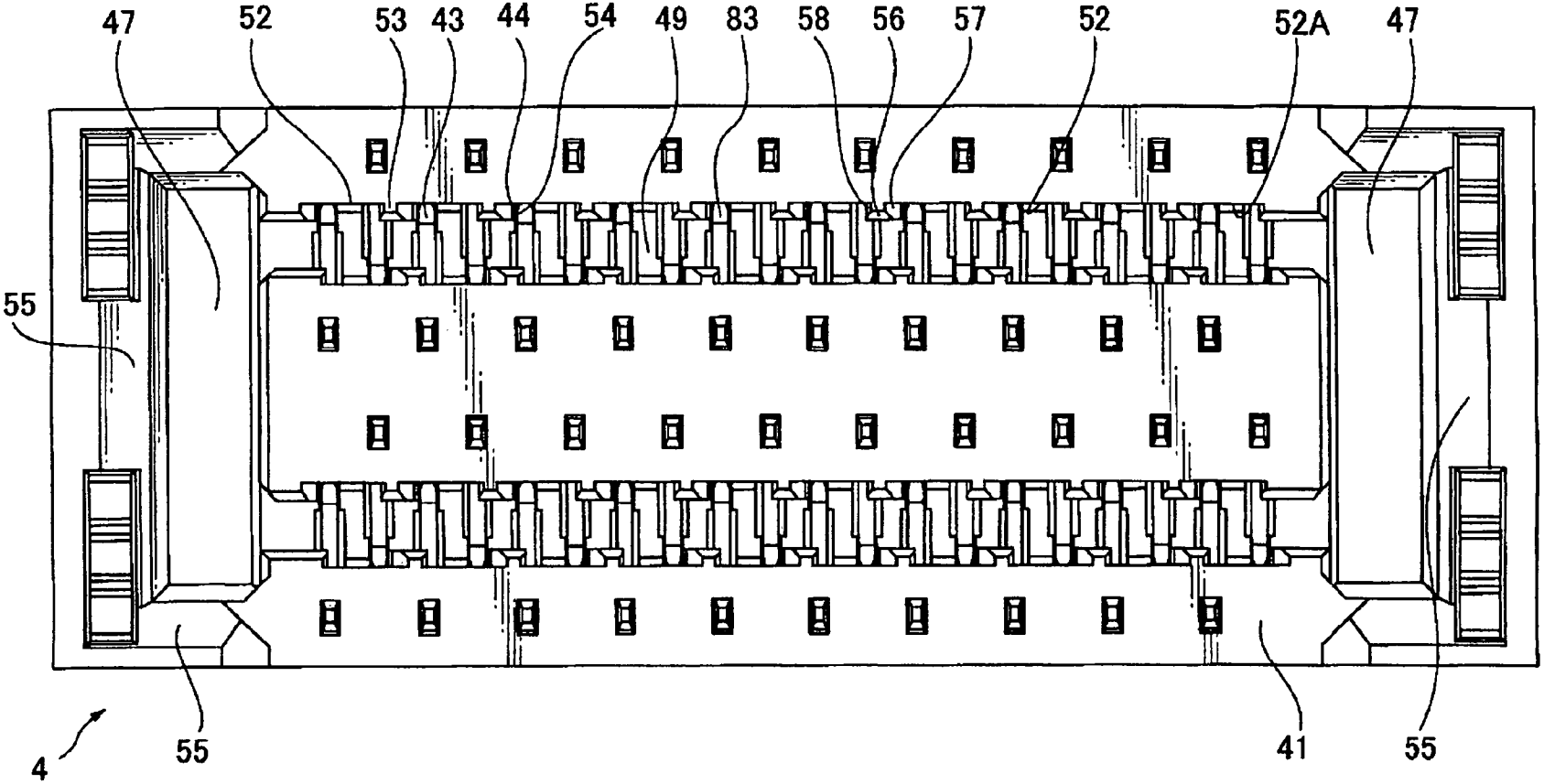
FIG. 4 is a plan view of the female connector.

In FIGS. 3 and 4, the female connector 4 includes an insulating housing 41, a plurality of female contact elements 43, and a pair of reinforcing member 45. The female connector 4 is surface mounted on a circuit board by soldering the bottoms of the reinforcing members 45.

The insulating housing 41 has at opposite ends thereof reinforcing member insertion apertures 50 into which the reinforcing members 45 are inserted for fixation. A pair of holding section fitting cavities 47 are provided to receive the holding sections 29 of the male connector 2. The fitting cavities 47 have a rectangular shape corresponding to the holding sections 29 of the male connector 2.

The insulating housing 41 also has a pair of arranging section fitting cavities 49 to receive the arranging sections 31 of the male connector 2. Where the arranging sections 31 are connected to the holding sections 29, the fitting cavities 49 are connected to the fitting cavities 47. A plurality of projections and recesses are provided in the fitting cavities 49 corresponding to the recesses and projections of the arranging sections 31 of the male connector 2.

Female contact elements 43 are arranged in the recesses of the fitting cavities 49 at regular intervals in zigzag fashion on opposed walls. Each female contact element 43 is disposed in each recess 52 in the fitting cavities 49 such that a side 44 of the female contact element 43 is close to or in contact with an inner wall 54 of the recess 52. Consequently, shift of the female contact element 43 in the longitudinal direction is prevented. The contact portion 83 of each female contact element 43 is made flexible so that it can move into the accommodation space (81, FIG. 8) of the recess 52 not to prevent plugging between the male connector 2 and the female connector 4.

To guide the male connector 2 to the female connector 4, guiding slopes 55 and 58 are provided on the fitting cavities 47 and the projections 53, respectively. The guiding slopes 55 and 58 also absorb an impact upon plugging between the male and female connectors 2 and 4. The projection 53 has a slope 56 extending in the longitudinal direction, a pair of slopes 57 and 58 extending in the direction perpendicular to the plugging and longitudinal directions. The slope 57, which is adjacent to the female contact element, is made larger than the slope 58 to prevent scrape away by the contact element of the male connector 2 upon plugging.

3. Plugging Condition

Figure 5:
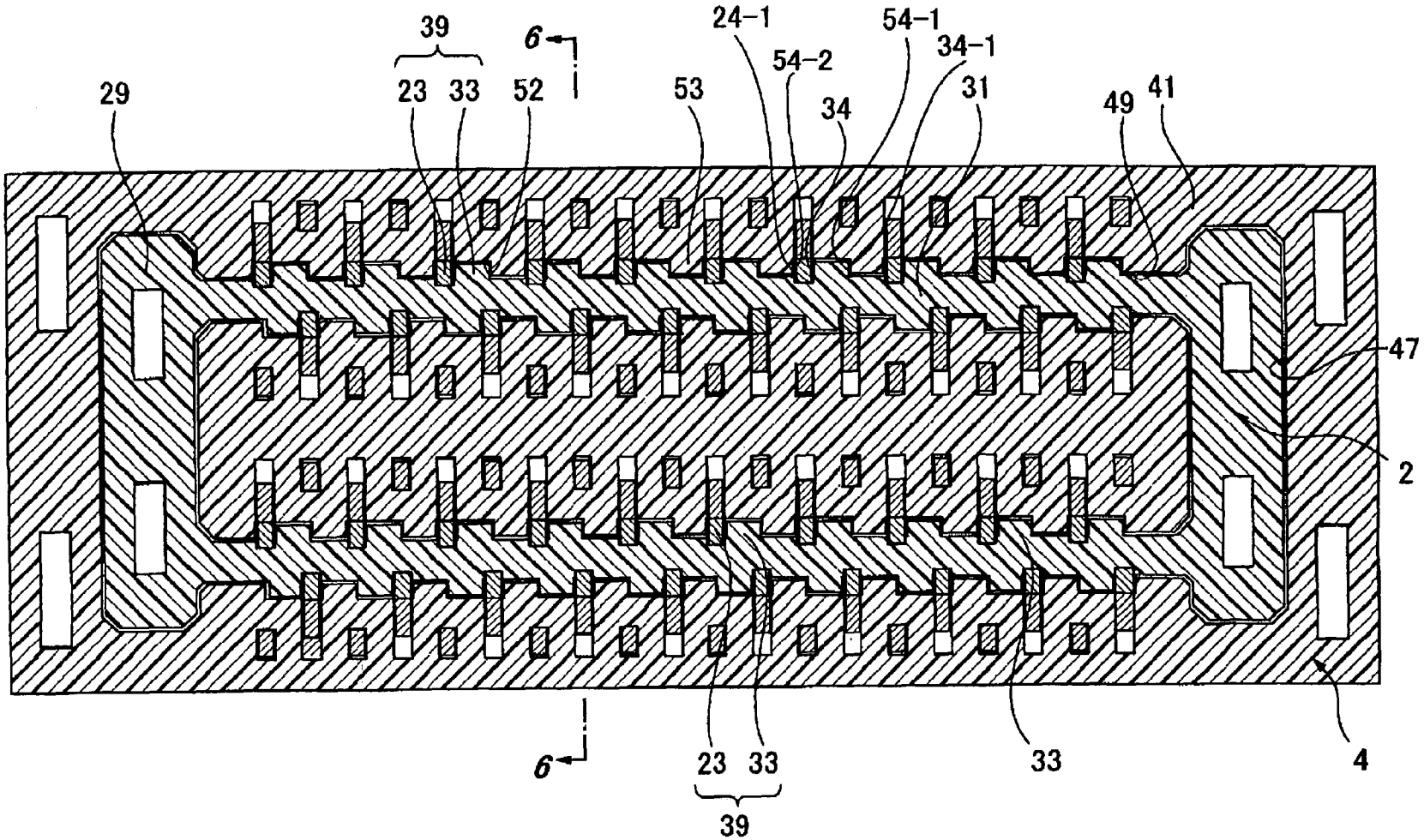
FIG. 5 is a sectional view of the plugged male and female connectors.

In FIG. 5, when the male and female connectors 2 and 4 are plugged, the holding section 29 and arranging section 31 of the male connector 2 are fitted into the fitting cavities 57 and the fitting cavities 49 of the female connector 4, respectively, so that the projections 39 of the male connector 2 mesh with the recesses 52 of the female connector 4. For example, the projection 33A in FIG. 2 meshes with the recess 52A in FIG. 4. The outer wall 34-1 of the projection 33 and a side 24-1 of the male contact element are opposed to the inner walls 54-1 and 54-2 of the recess 52 of the female connector 4, respectively. Consequently, the plugging position of the male and female connectors 2 and 4 are regulated to not only assure the connection but also making accurate contact positions between the respective contact elements in the longitudinal direction. The projections and recesses on the walls absorb an impact when the connector is dropped.

4. Contact Elements

Figure 6:
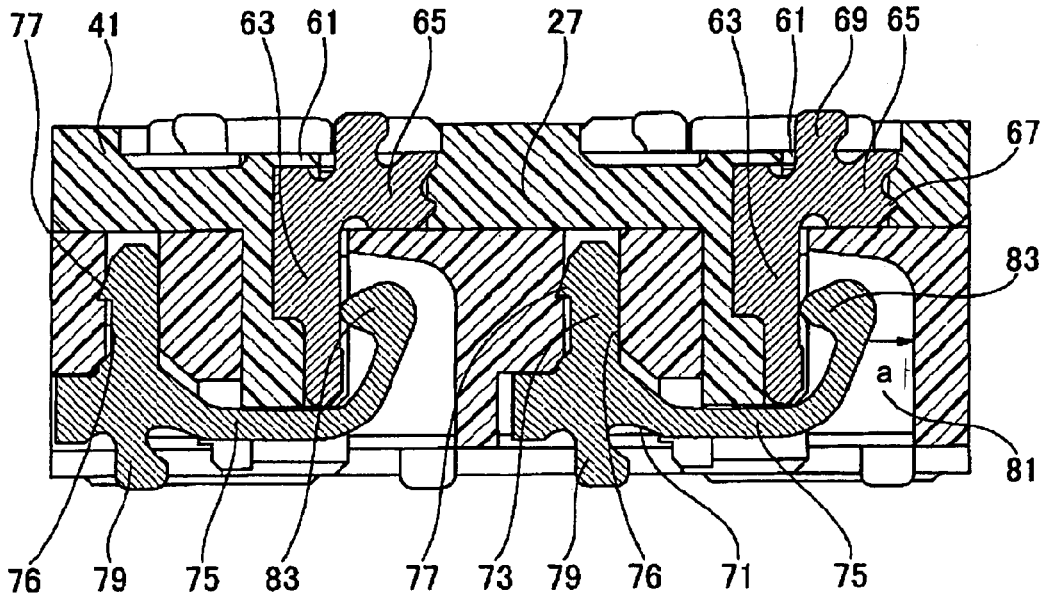
FIG. 6 is a sectional view taken along line 6—6 of FIG. 5.

The male contact element 23 and the female contact element 43 will be described in detail with reference to FIG. 6.

The male contact element 23 is inserted into an accommodation slot provided in the arranging section 31 for fixation. The L-shaped male contact has a vertical contact portion 63 inserted into the arranging section 31 through an entrance port 61 in the bottom plate 27. The horizontal leg portion 65 has an engaging projection 67 engaging with the wall of the entrance port 61 of the bottom plate 27. The protruded portion 69 is soldered to the corresponding circuit trace of a circuit board.

The female contact element 43 is inserted into an accommodation slot 71 provided in the fitting cavity 49 for fixation. It has a vertical fixing portion 73 and a C-shaped flexible arm 75 extending horizontally from an end of the fixing portion 73. The fixing portion 73 is inserted into a fixing slot 76 of an accommodation slot 71 fixed in place with an engaging projection 77. The protruded portion 79 is soldered to the corresponding trace of a circuit board. The flexible arm 75 extends into an open slot 81 and a contact tip 83 is flexible in the direction of an arrow (a). When the male and female connectors are plugged, the contact tip 83 is flexed by the male contact element 23 into the open slot 81. The resilient force of the flexible arm 75 assures the electrical and physical contact between the male and female contact elements 23 and 43.

B. Second Embodiment

The second embodiment will be described with reference to FIGS. 7–14. The description of the same structure as that of the first embodiment will be omitted.

Figure 7:
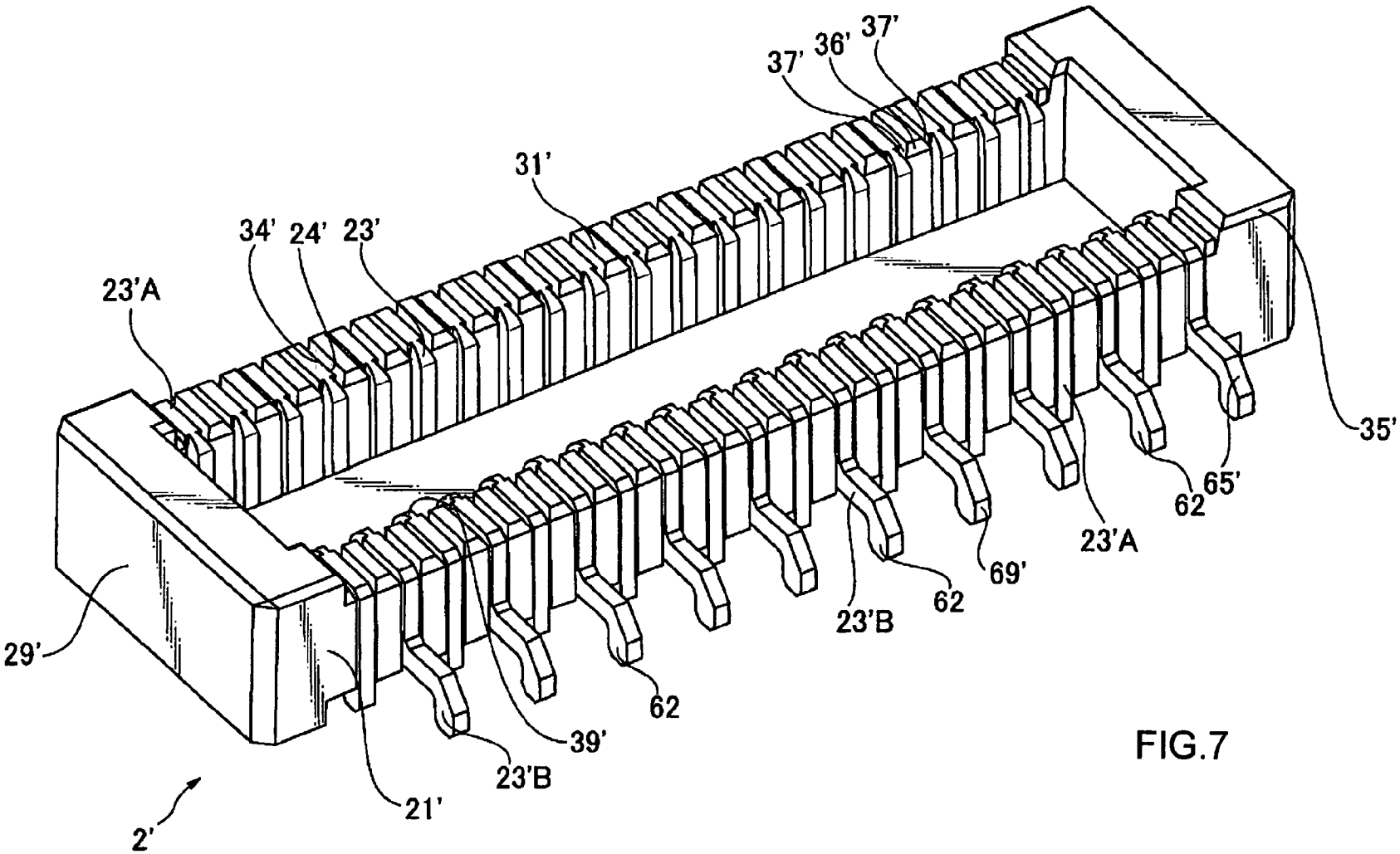
FIG. 7 is a perspective view of a male connector according to the second embodiment of the invention.
Figure 8:
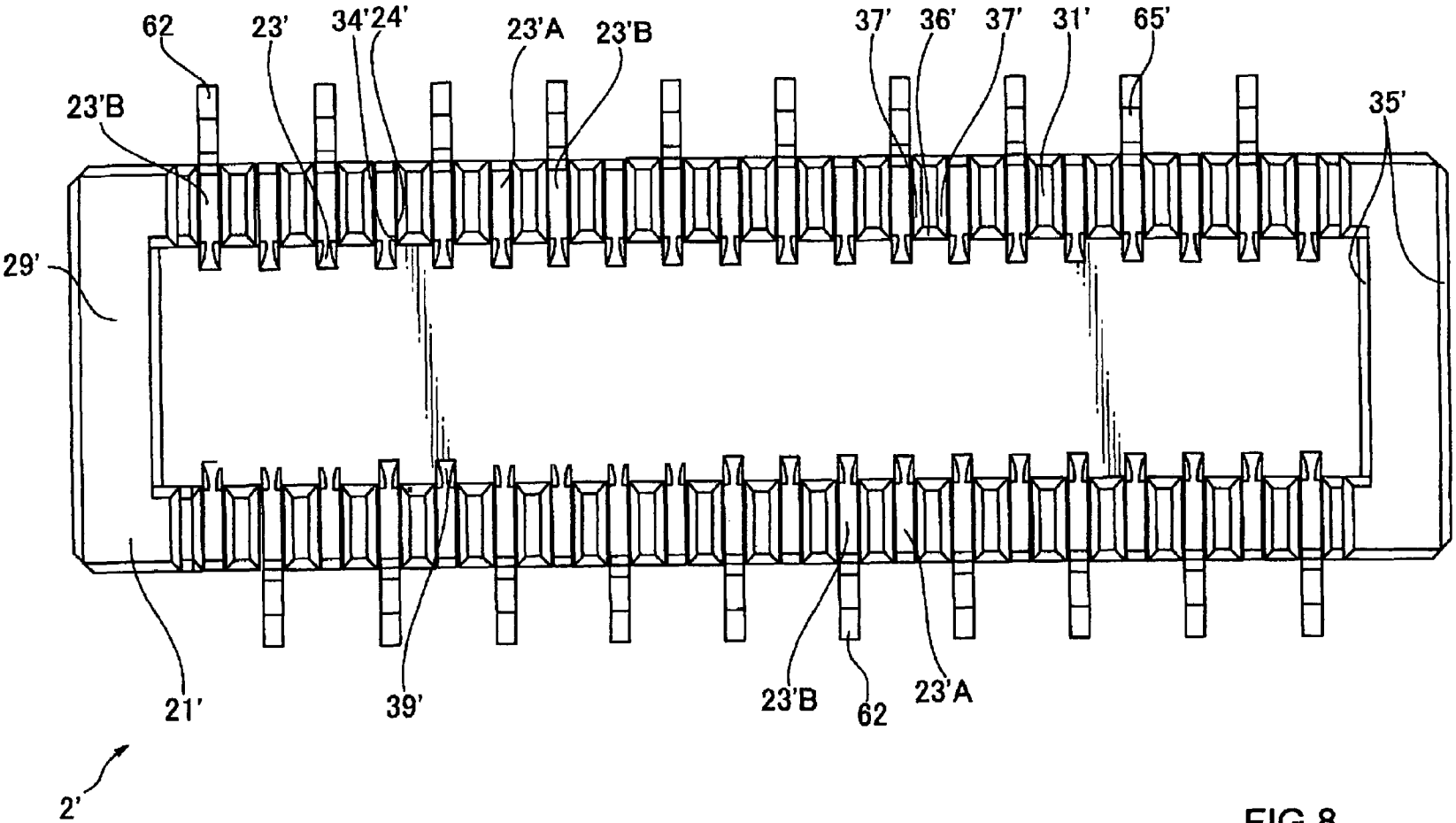
FIG. 8 is a plan view of the male connector of FIG. 7.
Figure 9:
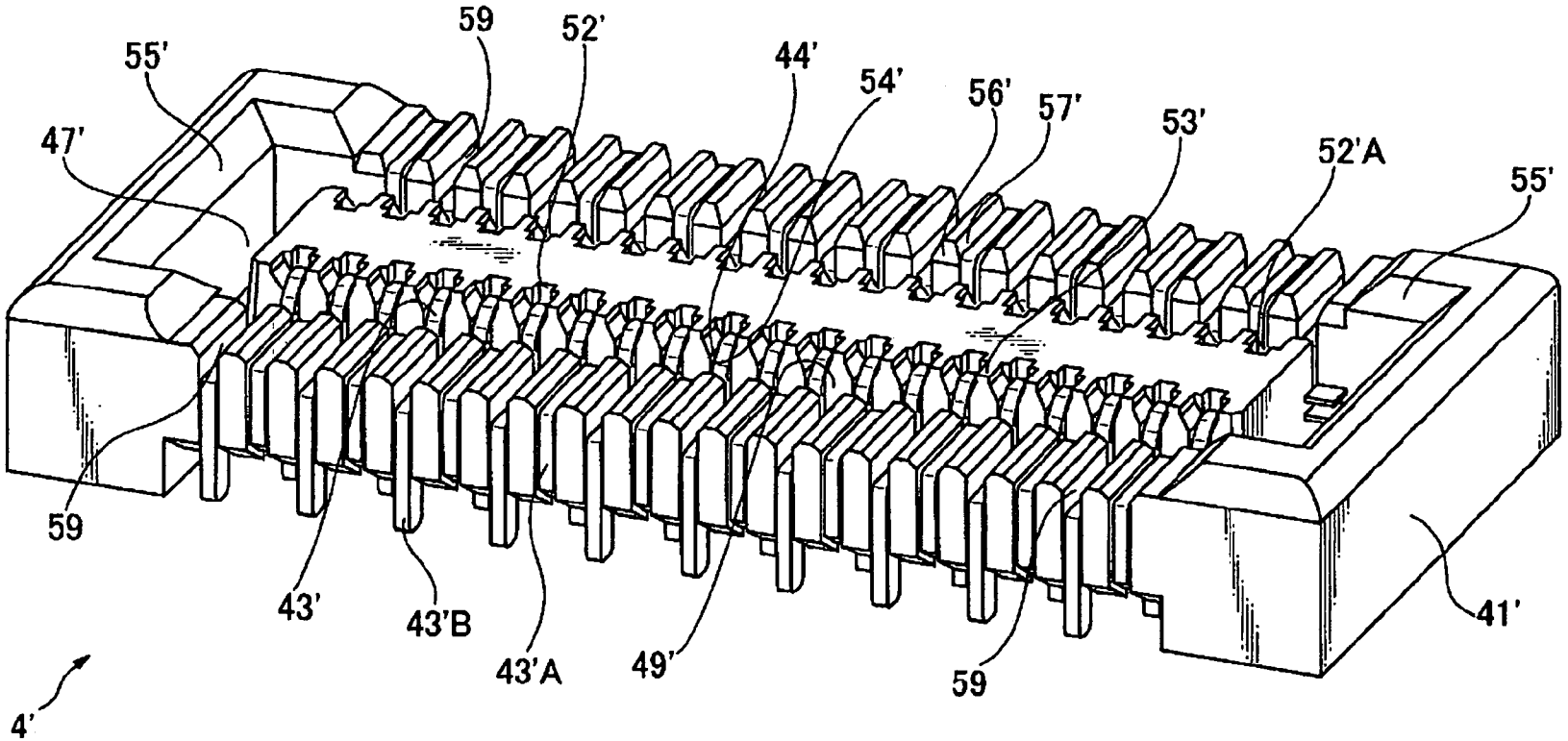
FIG. 9 is a perspective view of a female connector according to the second embodiment of the invention.
Figure 10:
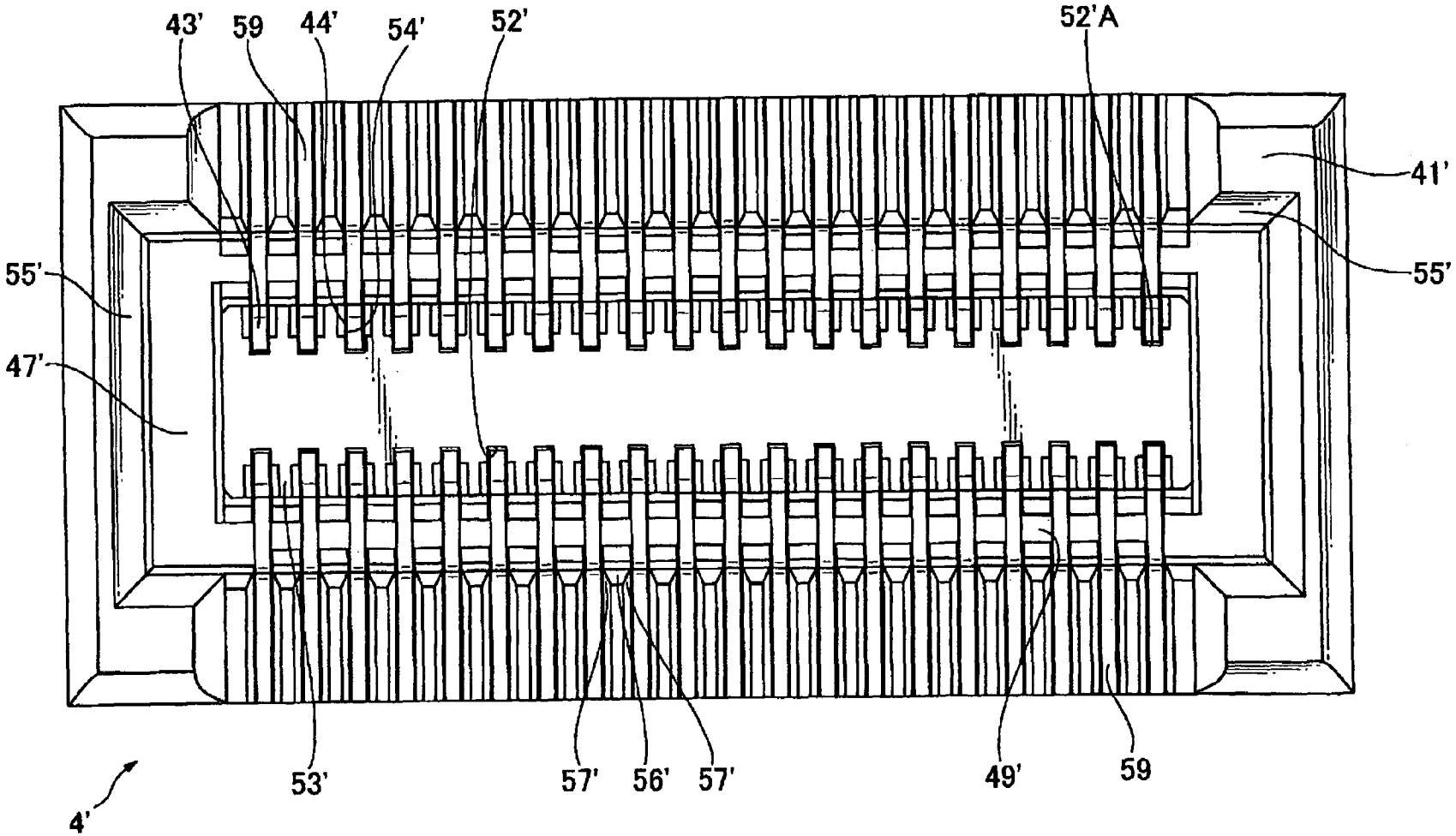
FIG. 10 is a plan view of the female connector of FIG. 9.
Figure 11:
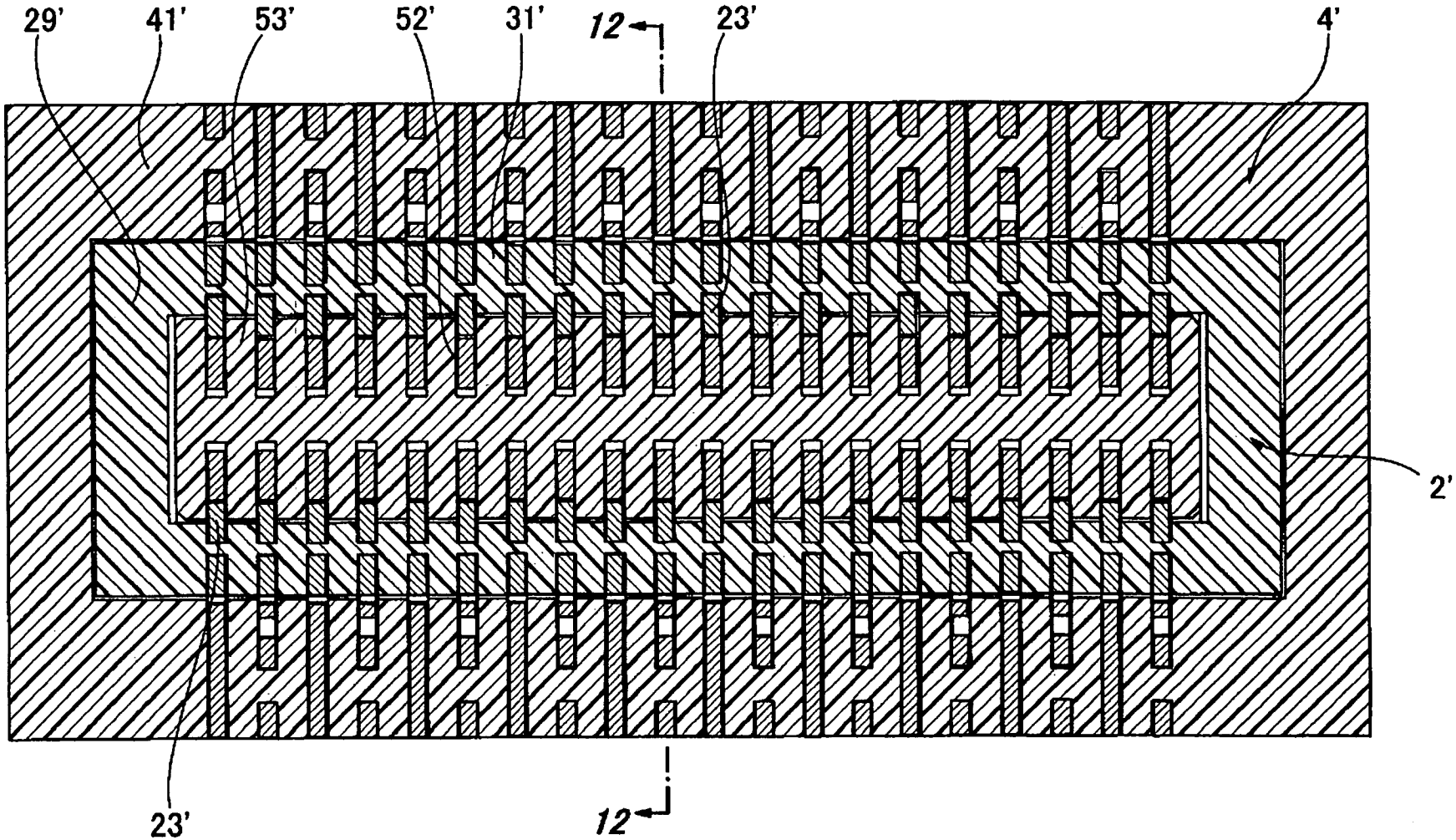
FIG. 11 is a sectional view of the plugged male and female connectors according to the second embodiment.

FIGS. 7 and 8 correspond to FIGS. 1 and 2. FIGS. 9 and 10 correspond to FIGS. 3 and 4. FIG. 11 and FIGS. 12–14, which correspond to FIG. 6, shows the contact conditions between male and female contact elements in stages. The arranging section 31' of the male connector 2' has no projection such as the projection 33 of FIG. 1 and only a male contact element 23' constitutes a projection 39'. This projection 39' meshes with a recess 52' of a female connector 4' on the one-to-one base.

Unlike the first embodiment, the male connector 2' has no bottom plate such as the bottom plate 27 of FIG. 1. For this reason, the leg portion 65' of the male contact element 23' is exposed to outside and an expanded area 69' of the leg portion 65' is soldered to the circuit board. Consequently, neither reinforcing member (25 of FIG. 1) nor holding section (29 of FIG. 1) are provided.

Instead, a pair of rectangular projections 29' are provided. Similarly, the female connector 4' has neither reinforcing member (45 of FIG. 3) nor insertion aperture (50 of FIG. 3).

There are two types of contact elements 23'A and 23'B for the male contact element 23' and 43'A and 43'B for the female contact element 43'. The male contact elements 23'A and 23'B are arranged alternately in the arranging sections 31' at regular intervals. Similarly, the female contact elements 43'A and 43'B are arranged alternately at regular intervals in the fitting cavities 49'. The respective contact elements 23' and 43' are arranged such that their opposite sides 24' and 44' are disposed adjacent to or in contact with the arranging sections 31' and the fitting cavities 49'. Consequently, the respective contact elements 23' and 43' are regulated at opposite sides so that the shift of contact elements 23' and 43' in the longitudinal direction is fully prevented.

The arranging sections 31' and the fitting cavities 49' are provided with slopes for guiding a mating connector. Especially, the arranging sections 31' are provided with three slopes 36', 37' and 37' of two types. The slope 36' extends in the longitudinal direction and the slopes 37' extends in the direction perpendicular to the plugging and longitudinal directions. On the other hand, the fitting cavities 49' are provided with three slops 56', and 57' and 57' of two types. The slope 56' extends in the longitudinal direction and the slopes 57' extend in the direction perpendicular to the plugging and longitudinal directions.

Figure 12:
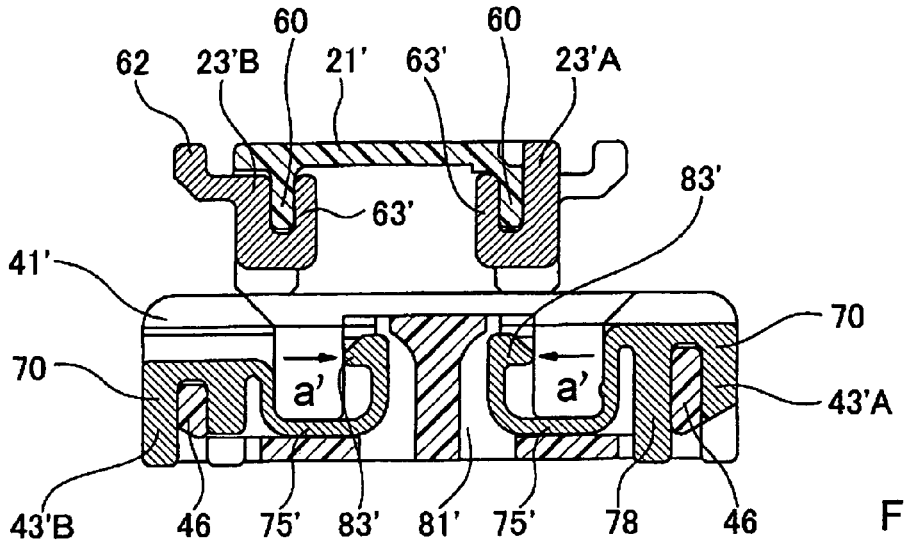
FIG. 12 is a sectional view taken along line 12—12 of FIG. 11.

As shown in FIG. 12, the contact element 23'A has a C-shaped form and the contact elements 23'B has a leg portion 62 extending from a C-shaped form. The C-shaped section including a contact portion 63' is press fitted over a projection 60 of the insulating housing 21' to fix the contact element 23' in place. Two types of female contact elements 43'A and 43'B are the same except for the size of portions. The female contact element 43' has a C-shaped section 70 and a C-shaped flexible arm 75' extending from a middle of the C-shaped section 70. The C-shaped section 70 is press fitted over a projection 46 of the insulating housing 41' to fix the contact element 43' in place. The flexible arm 75' has a similar shape to that of the first embodiment and a similar function to that of the first embodiment.

Figure 13:
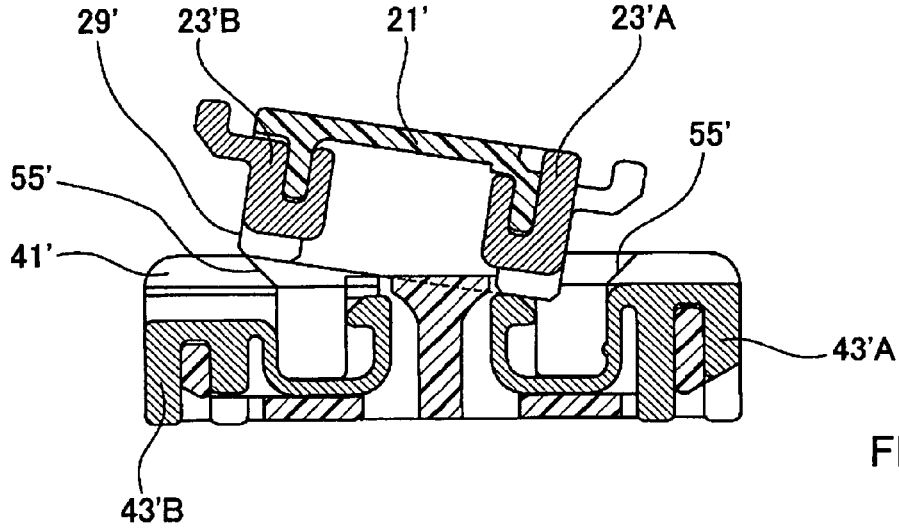
FIG. 13 is a sectional view wherein the male contact elements are going to come into contact with the female contact elements.

How the male contact element 23' is brought into contact with the female contact element 43' will be described with reference to FIGS. 12–14. When the male connector 2' is brought to the female connector 4' as shown in FIG. 12, suppose that the rectangular projection 29' of the male connector 2' strikes the slope 55' of the female connector 4', tilting the male connector 2' as shown in FIG. 13. Since the circuit board is much larger than the mounted connector, it is difficult for the user to see the contact condition between the connectors. However, the guiding slope 55' helps the male connector 2 to fit into the female connector 4'.

Figure 14:
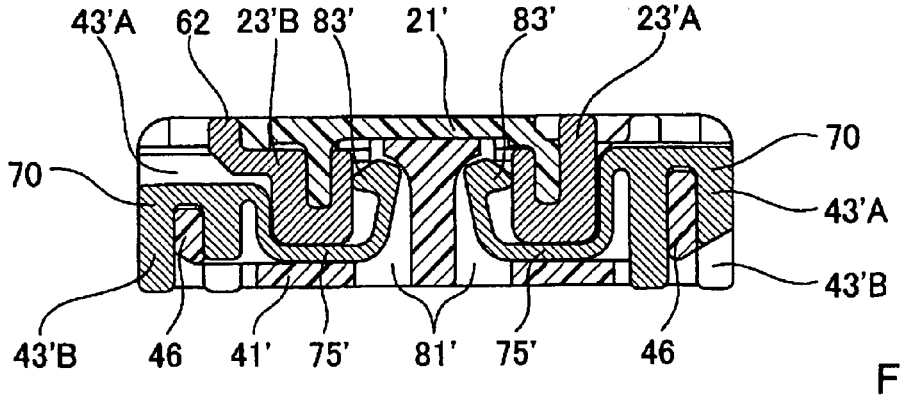
FIG. 14 is a sectional view wherein the male contact elements are in contact with the female contact elements.
Figure 15:
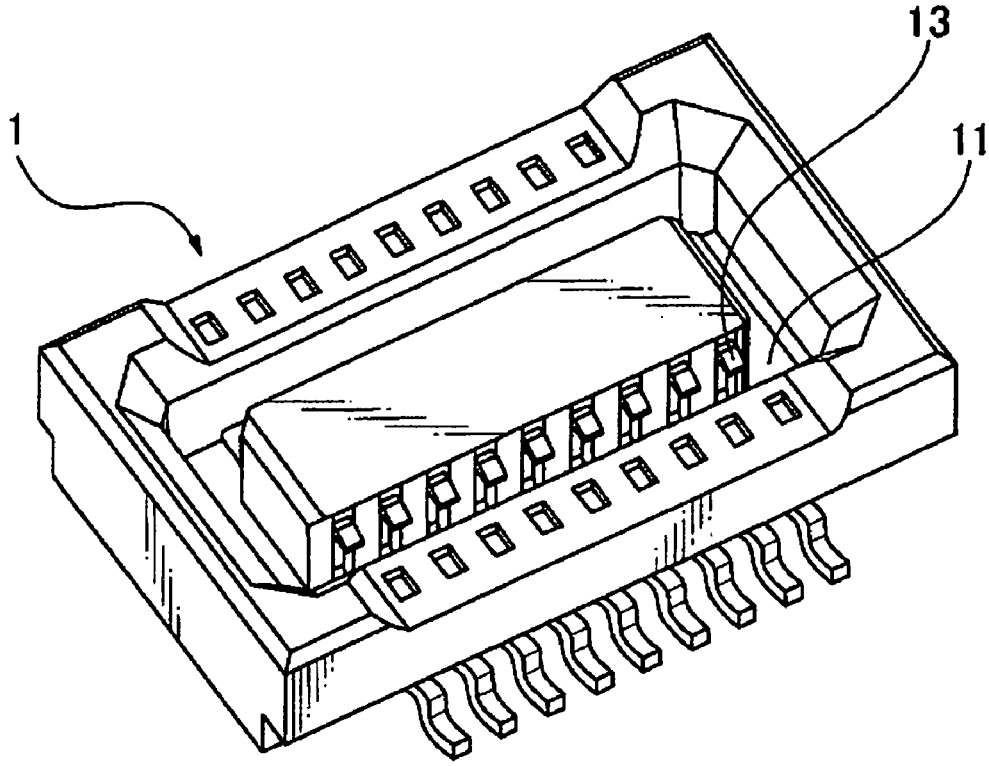
FIG. 15 is a perspective view of a conventional electrical connector.

As shown in FIG. 14, when the male and female connectors 2' and 4' are plugged to each other, the male contact element 23' resiliently deforms the flexible arm 75' of the female contact element 43' into the open slot 81' so that the female contact element 43' does not block plugging between the male and female connectors 2' and 4'. The resilient action of the flexible arm 75' assures the contact between the male and female contact elements 23' and 43'. As described above, the male and female contact elements 23' and 43' are regulated at opposite sides so that any longitudinal shift of contact elements during plugging is prevented. In addition, when the male and female connectors 2' and 4' are plugged to each other, the leg portion 62 of the male contact element 23' fits in the upper space 59 of the female contact element 43'B, thus preventing any longitudinal shift of the contact element.

A variation of the first embodiment includes a contact element which may be disposed between the projections 33 and 53 rather than adjacent to or in contact to the projection. On this case, the projections and recesses of the arranging section 31 mesh with the projections and recesses of the fitting cavity 49 to prevent a longitudinal shift of the contact element.

In the above embodiments, the male connector has two rows of the arranging sections and the female connector has two rows of fitting cavities, but one or more rows of arranging sections and fitting cavities may be possible. The intervals at which the contact elements are arranged may be made larger in the middle than in the ends of the arrangement so as to make it easier to plug the male and female connectors because no or little regulation is provided in the middle.

The arranging section and fitting cavity, which are continuously and linearly extend in the above embodiments, may be provided in an interrupted or curved fashion. It is essential that there is provided a regulation means for preventing a shift of contact elements. The projections on the arranging sections 31 and 31', which are formed with both the male contact element and the arranging section or only the male contact element, may be made by only the arranging section. The electrical connector according to the invention is useful for electrical connection between circuit boards.

What is claimed is:

1. An electrical connector comprising:

a first connector having a plurality of substantially L-shaped first contact elements;

a second connector having a plurality of second contact elements that are brought into contact with said first contact elements when said first and second connectors are plugged to each other in a plugging direction;

at least one arranging section provided on said first connector and extending in both said plugging direction and a longitudinal direction that is perpendicular to said plugging direction so as to support said first contact elements thereon;

at least one fitting cavity provided on said second connector and extending backwardly in said plugging direction and in said longitudinal direction so as to support said second contact elements on a wall thereof at positions corresponding to those of said first contact elements;

a plurality of first projections and recesses provided along on a first longitudinal side wall and an second longitudinal side wall opposite to the first longitudinal side wall of said arranging section in said longitudinal direction, with each of said first contact elements being disposed adjacent to or in contact with a side wall of each of said first projections to form a larger projection; and a plurality of second projections and recesses provided on said wall of said fitting cavity so as to mesh with said first projections and recesses, with said first contact elements being held between said first and second projections within said second recesses, when said first and second connectors are plugged to each other.

2. The electrical connector according to claim 1, wherein said first contact elements are provided adjacent to or in contact with said arranging section at a side thereof and said second contact elements are provided adjacent to or in contact with said wall of said fitting cavity at a side thereof.

3. The electrical connector according to claim 1, wherein said first contact elements are provided adjacent to or in contact with said arranging section on opposite sides thereof and said second contact elements are provided in said fitting cavity on opposite sides thereof.

4. The electrical connector according to claim 1, which further comprises at least one first slope provided on said arranging section for guiding said second connector and at least one second slope provided on a wall of said fitting cavity for guiding said first connector.

5. A first connector to be plugged to a second connector in a plugging direction, comprising:

at least one arranging section extending in both said plugging direction and a longitudinal direction that is perpendicular to said plugging direction;

a plurality of substantially L-shaped first contact elements provided on said arranging section and brought into contact with a plurality of second contact elements provided on a wall of a fitting cavity in said second connector when said first and second connectors are plugged to each other; and a plurality of first projections and recesses provided along on a first longitudinal side wall and an second longitudinal side wall opposite to the first longitudinal side wall of said arranging section in said longitudinal direction, with each of said first contact elements being disposed in each of said recesses adjacent to or in contact with a side wall of each of said projections to form a larger projection to mesh with a plurality of second projections and recesses provided on said wall of said fitting cavity so that said first contact elements are held between said first and second projections within said second recesses when said first and second connectors are plugged to each other.

6. The first connector according to claim 5, wherein said first contact elements are provided adjacent to or in contact with said projects at a side thereof.

* * * * *